US007749052B2

(12) United States Patent
Yi et al.

(10) Patent No.: US 7,749,052 B2
(45) Date of Patent: Jul. 6, 2010

(54) CARRIER HEAD USING FLEXURE RESTRAINTS FOR RETAINING RING ALIGNMENT

(75) Inventors: Jin Yi, Sunnyvale, CA (US); Jeonghoon Oh, San Jose, CA (US); Hung Chih Chen, Sunnyvale, CA (US); Samuel Chu-Chiang, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 12/206,338

(22) Filed: Sep. 8, 2008

(65) Prior Publication Data

US 2010/0062694 A1 Mar. 11, 2010

(51) Int. Cl.
*B24B 7/22* (2006.01)

(52) U.S. Cl. ..... 451/288; 451/398

(58) Field of Classification Search ..... 451/287, 451/288, 289, 388, 398
See application file for complete search history.

(56) References Cited

U.S. PATENT DOCUMENTS

| | | | | |
|---|---|---|---|---|
| 5,803,799 | A * | 9/1998 | Volodarsky et al. | 451/288 |
| 6,089,961 | A * | 7/2000 | Cesna et al. | 451/285 |
| 6,113,479 | A | 9/2000 | Sinclair et al. | |
| 6,540,590 | B1 * | 4/2003 | Kajiwara et al. | 451/41 |
| 6,848,981 | B2 | 2/2005 | Wen et al. | |
| 2004/0200733 | A1 | 10/2004 | Wadensweiler et al. | |
| 2008/0119118 | A1 | 5/2008 | Zuniga et al. | |
| 2008/0119119 | A1 | 5/2008 | Zuniga et al. | |
| 2008/0119120 | A1 | 5/2008 | Zuniga et al. | |

* cited by examiner

*Primary Examiner*—Robert Rose
(74) *Attorney, Agent, or Firm*—Patterson & Sheridan, LLP

(57) ABSTRACT

One embodiment provides a retaining ring assembly. The retaining ring assembly comprises a retaining ring configured to circumferentially surround and retain the substrate within an inner surface of the retaining ring, and a flexure coupled to the retaining ring. The flexure is configured to maintain a gap between an inner surface of a carrier ring and an outer surface of the retaining ring, and the carrier ring is circumferentially surrounding the retaining ring.

20 Claims, 10 Drawing Sheets

CARRIER HEAD USING FLEXURE RESTRAINTS FOR RETAINING RING ALIGNMENT

BACKGROUND OF THE INVENTION

1. Field of the Invention

Embodiments of the invention generally relate to method and apparatus for electrochemical mechanical planarization and chemical mechanical planarization. More specifically, embodiments of the present invention relate to carrier heads used in planarization.

2. Description of the Related Art

Presently a carrier ring is coupled to a carrier head, of a polishing assembly of an electrochemical mechanical planarization (ECMP) or a chemical mechanical planarization (CMP) apparatus, and circumferentially surrounds a retaining ring. The retaining ring circumferentially surrounds a substrate and retains the substrate within an inner diameter of the retaining ring, and provides edge processing control. The carrier ring and retaining ring are both configured to contact a polishing surface of the ECMP or CMP apparatus during polishing. The carrier ring provides relative positioning of referencing of the carrier head to the polishing surface. The carrier ring laterally contacts the retaining ring with an inside surface of the carrier ring, at a lower portion of an outside surface of the retaining ring during processing of the substrate and provides lateral referencing of the retaining ring.

Because carrier ring/retaining ring interaction area is close to the substrate processing area, the carrier ring/retaining ring interaction may affect processing of the substrate. The interaction causes undesirable defects in the substrate. The defects can be caused in a number of ways, some of which include uneven wear on the retaining ring and vibrations between the carrier ring and retaining ring. The defects can further affect the service life of all the components of the apparatus.

Therefore, a need exists to establish a new carrier ring/retaining ring interaction while eliminating the direct surface to surface contact between the carrier ring and retaining ring near the substrate processing area.

SUMMARY OF THE INVENTION

Embodiments of the present invention provide a carrier head for securing a substrate during processing and polishing.

One embodiment provides a retaining ring assembly used in a carrier head. The retaining ring assembly comprises a retaining ring configured to circumferentially surround and retain the substrate within an inner surface of the retaining ring, and a flexure coupled to the retaining ring. The flexure is configured to maintain a gap between an inner surface of a carrier ring and an outer surface of the retaining ring, and the carrier ring is circumferentially surrounding the retaining ring.

In another embodiment, a carrier head for securing a substrate during processing comprises a retaining ring configured to circumferentially surround and retain the substrate on the carrier head, a carrier ring, wherein the carrier ring circumferentially surrounds the retaining ring, and a flexure coupled between the carrier ring and retaining ring, wherein the flexure is substantially resistive to movement of the retaining ring in a direction perpendicular to an inner surface of the carrier ring and substantially non resistive to movement of the retaining ring in a direction parallel to the inner surface of the carrier ring.

In another embodiment, a polishing head for securing a substrate during polishing comprises a carrier head, an annular flexible membrane coupled to the carrier head, a retaining ring, configured to circumferentially surround and retain the substrate on the carrier head, coupled to the annular flexible membrane, a carrier ring circumferentially surrounding the retaining ring and coupled to the carrier head, and a flexure coupled between the carrier ring and retaining ring.

BRIEF DESCRIPTION OF THE DRAWINGS

So that the manner in which the above-recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Embodiments of the present invention provide a carrier head for securing a substrate during processing and polishing. One embodiment provides a retaining ring assembly used in a carrier head. The retaining ring assembly comprises a retaining ring configured to circumferentially surround and retain the substrate within an inner surface of the retaining ring, and a flexure coupled to the retaining ring. The flexure is configured to maintain a gap between an inner surface of a carrier ring and an outer surface of the retaining ring, and the carrier ring is circumferentially surrounding the retaining ring. The gap maintained between the carrier ring and retaining ring prevents interactions among the carrier ring, the retaining ring, and the substrate being processed thus reducing defects. The flexure also allows easy adjustment and replacement of the retaining ring.

Figure 1:
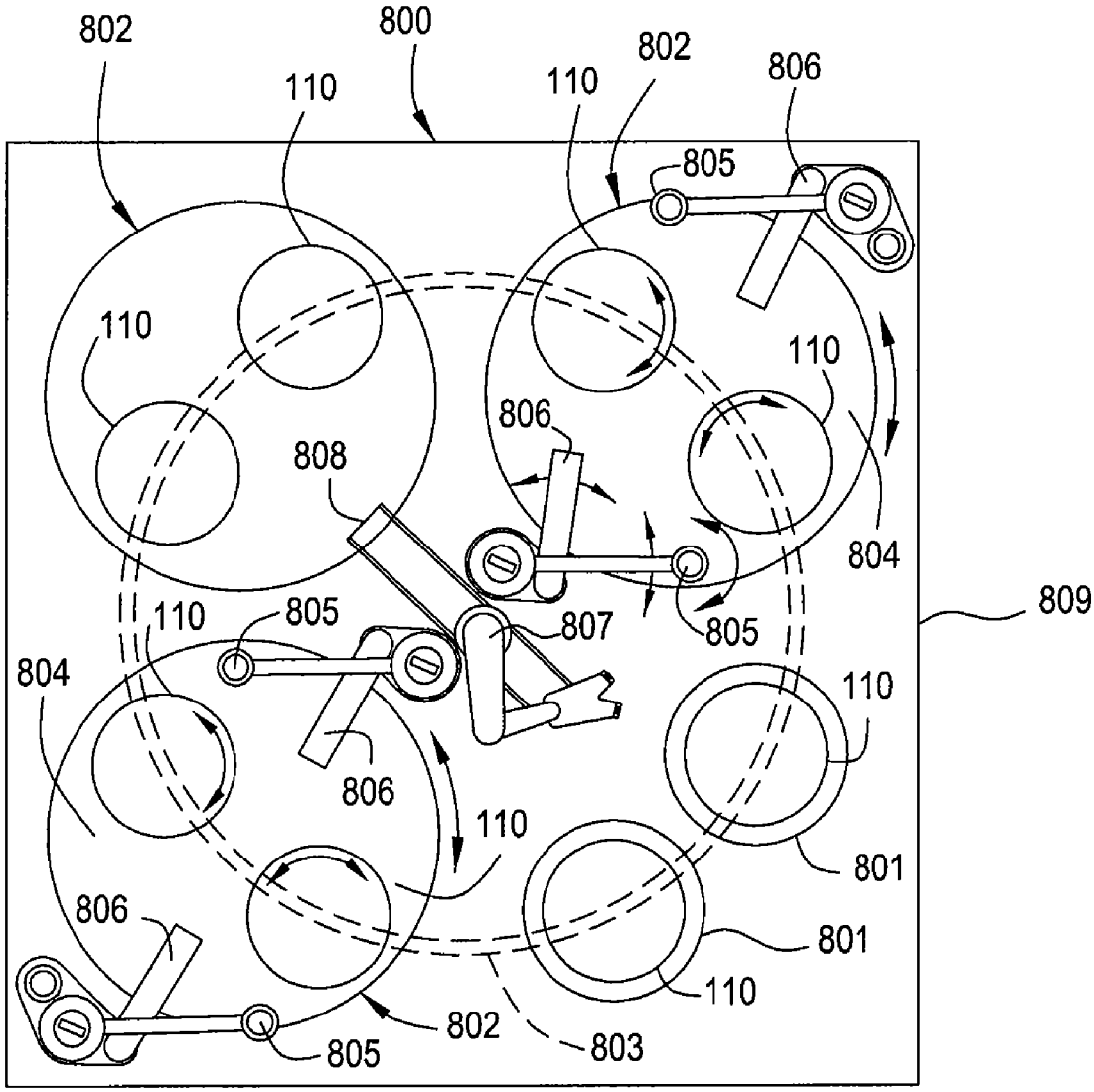
FIG. 1 is a schematic plan view of one embodiment of a polishing module in accordance with one embodiment of the present invention. The polishing module comprises one or more carrier heads having flexures in accordance with embodiments of the present invention.

FIG. 1 is a schematic plan view of one embodiment of a polishing module 800 configured to perform CMP or ECMP process having two or more polishing steps.

The polishing module 800 comprises a plurality of polishing stations 802 and one or more load cups 801 coupled to a station frame 809. The plurality of polishing stations 802 are configured to polished substrates 109 (shown in FIG. 2) retained in one or more carrier heads 110.

The polishing stations 802 may be sized to interface with one or more carrier heads 110 simultaneously so that polishing of one or more substrates 109 may occur at a single polishing station 802 at the same time.

Each polishing station 802 generally comprises a polishing surface 804, a conditioning module 805 and a polishing fluid delivery module 806. The polishing surface 804 is supported on a platen assembly (not shown) which rotates the polishing surface 804 during processing. In one embodiment, the polishing surface 804 is suitable for at least one of a chemical mechanical polishing and/or an electrochemical mechanical polishing process. The polishing surface 804 is configured, in one embodiment, to accommodate polishing of at least two substrates 109 simultaneously thereon. In such an embodiment, the polishing station 802 includes two conditioning modules 805 and two polishing fluid delivery modules 806 which condition and provide polishing fluid to the region of the polishing surface 804 just prior to interfacing with a respective substrate 109. Additionally, each of the polishing fluid delivery modules 806 are positioned to provide independently a predetermined distribution of polishing fluid on the polishing surface 804 so that a specific distribution of polishing fluid is respectively interfaced with each substrate 109 during processing.

The load cups 801 are configured to support substrates while the substrates are loaded to the carrier heads 110 before polishing or unloaded from the carrier heads 110 after polishing. State of the art load cups are described in U.S. Pat. No. 7,044,832, entitled "Load Cup for Chemical Mechanical Polishing".

The carrier heads 110 are coupled to a mounting assembly 101 (shown in FIG. 2) movably coupled to an overhead track 803. The overhead track 803 allows the mounting assembly 101 to be selectively positioned around the polishing module 800 which facilitates positioning the carrier heads 110 selectively over the polishing stations 802 and load cups 801. In the embodiment depicted the overhead track 803 has a circular configuration (shown in phantom) which allows the mounting assemblies 101 retaining the carrier heads 110 to be selectively rotated over and/or clear of the load cups 801 and the polishing stations 802. It is contemplated that the overhead track 803 may have other configurations including elliptical, oval, linear or other suitable orientations.

In one embodiment, the overhead track 803 is coupled to a track frame 104 (shown in FIG. 2) while the polishing stations 802 are coupled to a station frame 809. The station frame 809 and the track frame 104 are coupled to a floor (not shown) of a facility without being connected to each other. The decoupled station frame 809 and the track frame 104 allow vibrations associated with the movement of the mounting assemblies 101 to be substantially isolated from the polishing surface 804, thereby minimizing potential impact to polishing results. Moreover, utilization of the station frame 809 without a machine base provides significant cost savings over conventional designs.

An optional staging robot 807 may be employed to transfer the substrate 109 between the load cups 801. The staging robot 807 may be slidably mounted to a track 808 to increase the range of motion of the robot 807. The track 808 may be linear, as shown, circular or other configuration. The staging robot 807 may also be configured to flip the substrate for interfacing with a substrate metrology unit (accessory device) or positioned elsewhere within the range of motion of the robot 807.

Although the embodiment of FIG. 1 depicts the polishing module 800 having two polishing stations 802, it is contemplated that the polishing module 800 may comprise a single polishing station 802, three polishing stations 802, or other number of polishing stations 802 which may fit on the polishing module 800. It is also contemplated that the polishing module 800 may include a single load cup 801 to service all of the polishing stations 802, or other number of load cups 801 desired.

Figure 2:
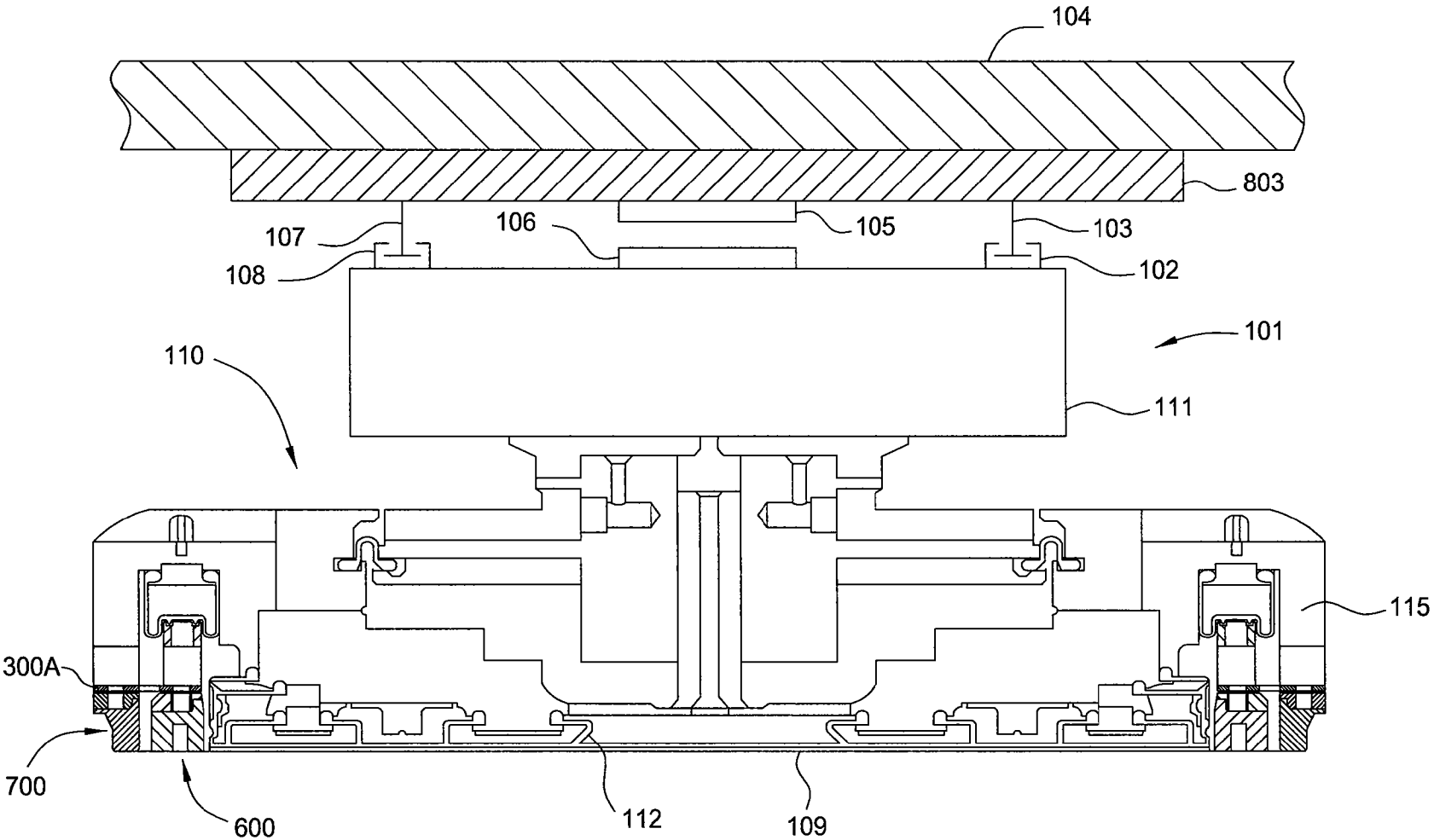
FIG. 2 is a schematic plan view of one embodiment of a polishing head assembly with a carrier head having flexures.

FIG. 2 schematically depicts the carrier head 110 coupled to the mounting assembly 101 of the polishing module 800 shown in FIG. 1. FIG. 2 schematically illustrates the interface between the overhead track 803 and the mounting assembly 101. The mounting assembly 101 comprises guide blocks 102, 108 which are movably coupled to rails 103, 107 of the overhead track 803. The rails 103, 107 are coupled to the overhead track 803. The rails 103, 107 and guide blocks 102, 108 allow the mounting assembly 101 and the carrier head 110 to move along a path defined by the overhead track 803.

Each mounting assembly 101 is controllably positioned along the overhead track 803 by an actuator 106. The actuator 106 may be in the form of a gear motor, servo motor, linear motor, sawyer motor or other motion control device suitable for accurately positioning the mounting assembly 101 on the overhead track 803. The mounting assembly 101 is utilized to position the carrier head 110 over the load cups 801 or polishing surface 804, to sweep the carrier head 110 across polishing surface 804 during processing, or to position the carrier head 110 clear of the load cups 801 and polishing surface 804 for maintenance of the carrier head 110, the load cups 801 or polishing surface 804. In one embodiment, the actuator 106 is a linear motor that interfaces with a magnetic track 105 coupled to the overhead track 803. The magnetic track 105 comprises permanent magnets arranged in alternating polarity so that each mounting assembly 101 may be moved independently of the other mounting assemblies 101 coupled to the overhead track 803.

In one embodiment, the carrier head 110 comprises a body 115, an actuator (not shown) configured to position the body 115 relative to the polishing surface 804. The carrier head 110 further comprises a motor 111 configured to controllably rotate the carrier head 110 and the substrate 109 retained therein during processing. In one embodiment the actuator allows the carrier head 110 to be pressed against the polishing surface 804 at about 6 psi or less, such as less than about 1.5 psi.

Referring to FIG. 1, during polishing, the carrier head 110 rotates the substrate 109 and presses the substrate 109 against the polishing surface 804 which is also rotating. A polishing fluid is provided to the polishing surface 804 during polishing. The carrier head 110 may optionally be swept back and forth during processing to improve polishing uniformity. In one embodiment, the sweeping motion of the carrier heads 110 is performed by oscillating the carrier heads 110 along a small range along the overhead track 804.

Referring to FIG. 2, in one embodiment, the carrier head comprises a flexible membrane 112 configured to retain the substrate 109 by forming vacuum pockets between the flexible membrane 112 and a backside of the substrate 112. In one embodiment, the flexible membrane 112 is circular. The flexible membrane 112 is generally coupled to a bottom side of body 115 and has a surface area substantially similar to a surface area of the substrate 109. The carrier head 110 further comprises a carrier ring 700 and a retaining ring 600. The carrier ring 700 and retaining ring 600 are disposed substantially concentrically surrounding the flexible membrane 112. The carrier ring 700 is coupled to the body 115 near an outer perimeter of the carrier head 110. The retaining ring 600 is movably coupled with the body 115 of carrier head 110 inside the carrier ring 700.

Detailed description of embodiments of carrier heads comprising a retaining ring and carrier ring may be found in U.S. patent application Ser. No. 11/862,096, filed Sep. 26, 2007 which is hereby incorporated by reference in its entirety.

State of the art retaining rings are described in U.S. Pat. Nos. 7,374,393, 7,344,434, 7,210,991, 7,276,743, 7,134,948, and 6,821,192.

In one embodiment, one or more flexures 300A are coupled to both the retaining ring 600 and the carrier ring 700. The flexure 300A is configured to maintain a gap between the retaining ring 600 and the carrier ring 700 and to avoid contact between the retaining ring 600 and the carrier ring 700 during processing.

Figure 3:
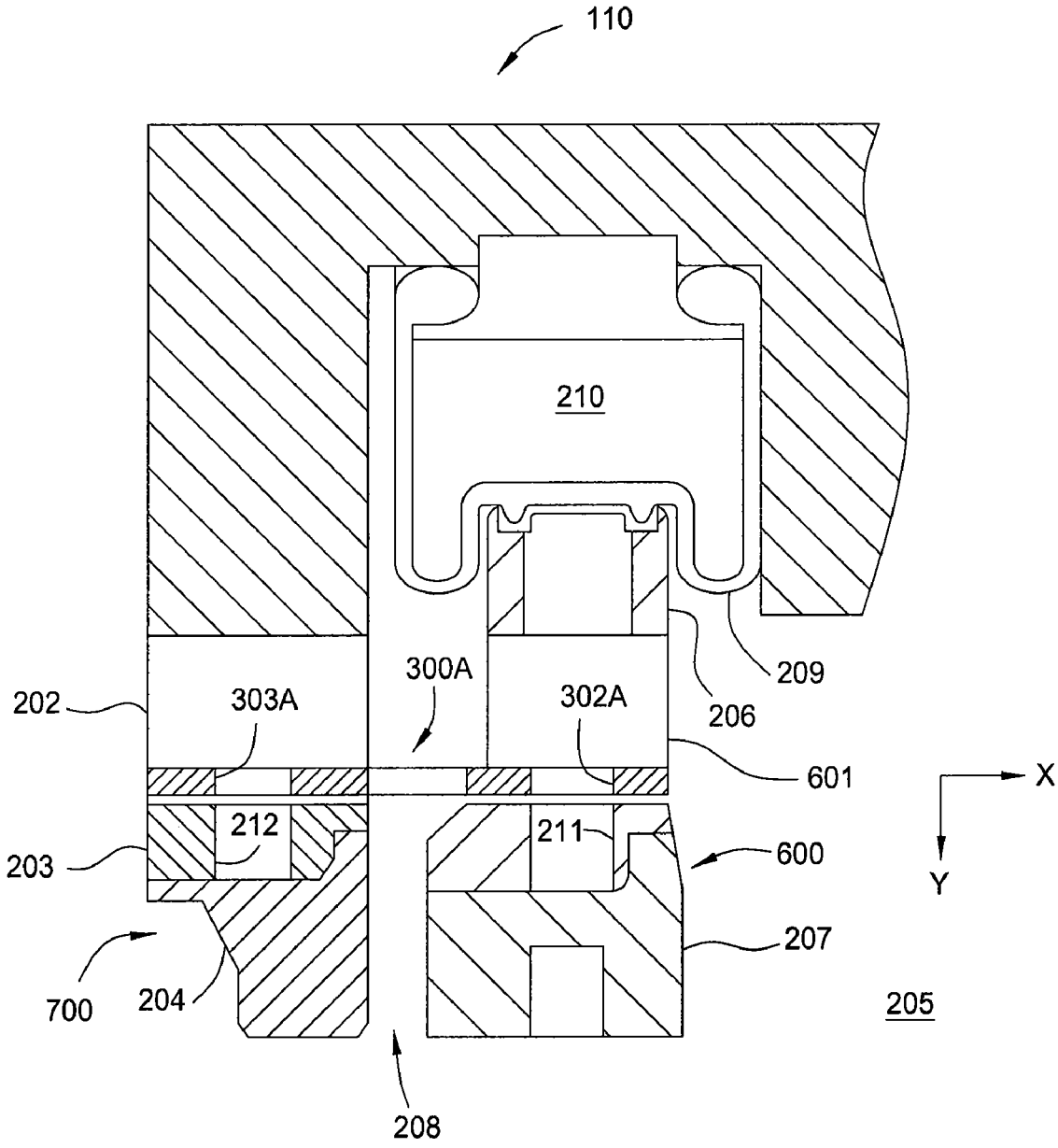
FIG. 3 schematically illustrates the positioning of a flexure relative to other components of the carrier head in accordance with the embodiment of FIG. 2.

FIG. 3 is partial enlarged view of FIG. 2, and shows the positioning of the flexures 300A relative to the retaining ring 600 and the carrier ring 700 in accordance with one embodiment. The one or more flexures 300A are distributed around the retaining ring 600 and carrier ring 700. Each flexure 300A limits the lateral movement, such as movement in the X direction, of the retaining ring 600 relative to the carrier ring 700. Each flexure 300A retains a gap 208 between the carrier ring 700 and retaining ring 600, but still allow for a vertical bias between the carrier ring 700 and retaining ring 600, such as a movement in the Y direction due to relative motion between the retaining ring 600 and the carrier head 110, which the carrier ring 700 is coupled to in a fixed manner.

Each flexure 300A may also have one or more additional flexures 300A coupled thereto in a stacked fashion. In one embodiment, stacking one or more flexures 300A provides additional strength by distributing forces exerted on each flexure 300A to another flexure 300A in the stack of flexures 300A.

Because the retaining ring 600 wears at a faster rate than the carrier ring 700, it is desirable to have one of the carrier ring 700 or retaining ring 600 be movable relative to the carrier head 110 to align the lower surfaces of the two rings. In one embodiment, the retaining ring 600 is movably coupled to the carrier head 110 via an annular flexible membrane 112 coupled to the body 115 of the carrier head 110. The annular flexible membrane 209, coupled between the carrier head 110 and retaining ring 600, encloses an annular cavity 210 which can be inflated or deflated to move the retaining ring 600 vertically from the carrier head 110 and parallel to the carrier ring 700. The annular flexible membrane 209 allows the retaining ring 600 to be lowered as the retaining ring 600 wears during the polishing process. Therefore, the retaining ring 600 can continuously retain the substrate during processing for the entire service life of the retaining ring 600.

The flexures 300A are configured to allow vertical movement of the retaining ring 600, but keep the retaining ring 600 from moving laterally due to the resistive properties of the flexures 300A for all wear patterns of the carrier ring 700 and retaining ring 600. Thus, the retaining ring 600 is kept at an acceptable distance away from the carrier ring 700, and the interaction of the carrier ring 700 and retaining ring 600 near the processing area 205 is eliminated.

Figure 4:
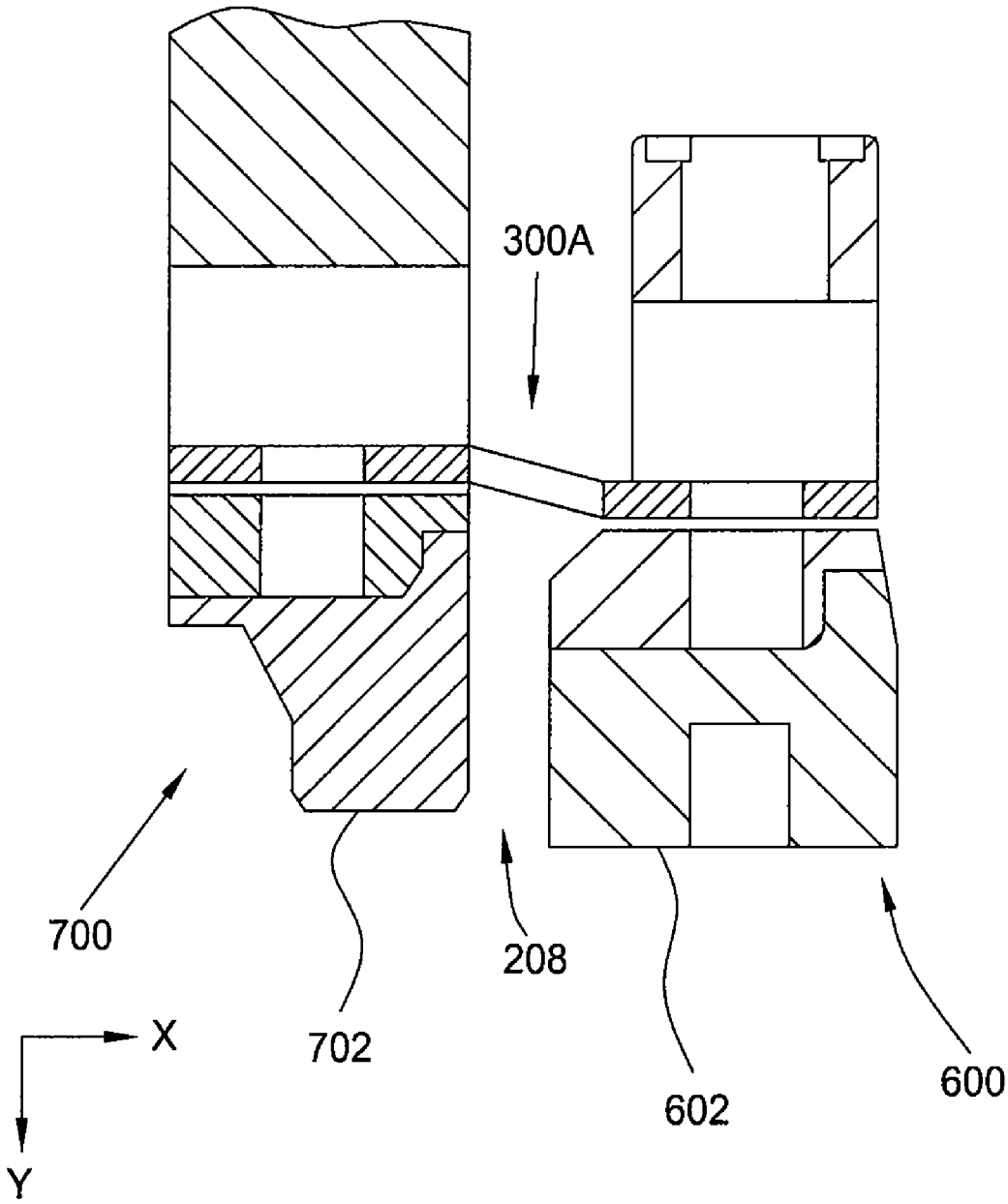
FIG. 4 schematically illustrates a vertical displacement of a retaining ring relative to a carrier head in accordance with one embodiment of the present invention.

FIG. 4 schematically illustrates the retaining ring 600 displaced vertically from the carrier head 110, and parallel to an inside surface of the carrier ring 700. This displacement helps to align a lower surface 702 of the carrier ring 700 with a lower surface 602 of the retaining ring 600 for proper contact with the polishing surface 804 when the lower portion 207 of the retaining ring 600 has worn. The flexures 300A bend to allow for vertical displacement of the retaining ring 600, but retain the gap 208 between the carrier ring 700 and retaining ring 600.

Some positive impacts of the positioning the flexures 300A between the retaining ring 600 and carrier ring 700 include an improved even wear of the carrier ring 700 and retaining ring 600, an improved even distribution of support of the retaining ring 600, and improved accurate positioning of the carrier head 110 and retaining ring 600 during processing. Therefore, the flexures 300A reduce defects of the substrate 109 and extend service life for all the components.

Figure 5:
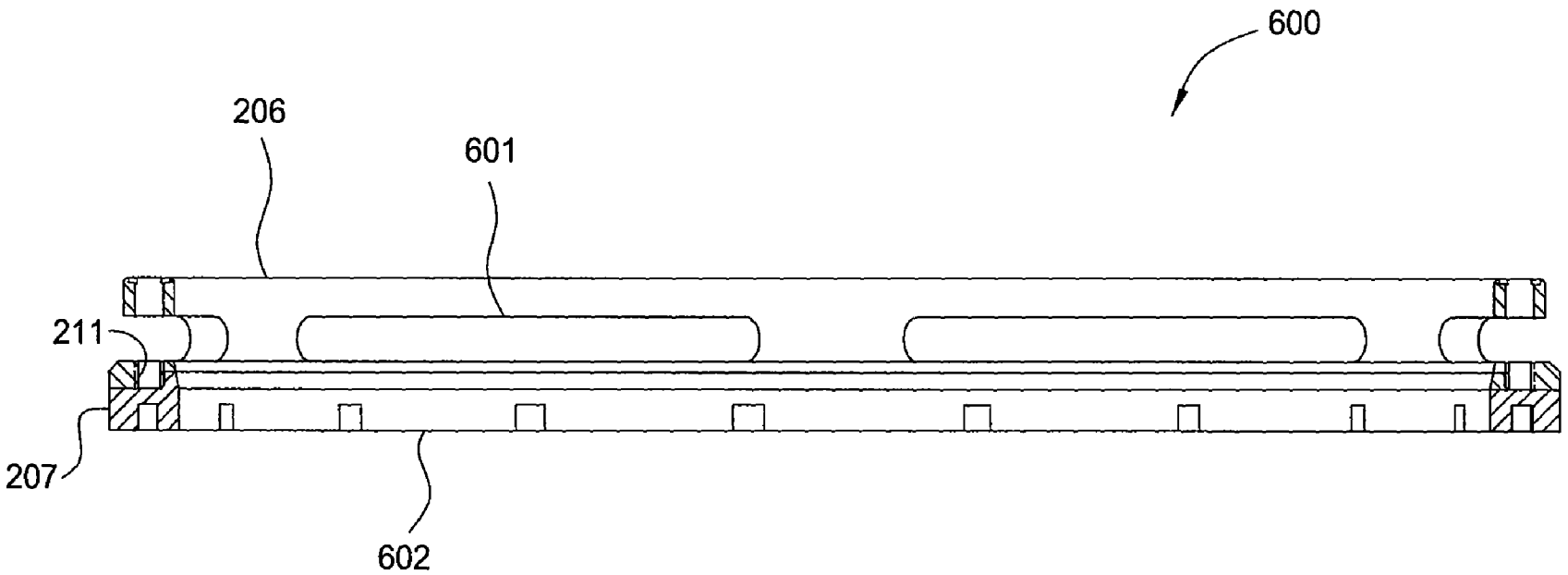
FIG. 5 schematically shows a retaining ring in accordance with one embodiment of the present invention.

In one embodiment, as shown in FIG. 5, the retaining ring 600 comprises of a lower portion 207 and an upper portion 206 coupled to the lower portion 207. The lower portion 207 is configured to contact the polishing surface 804 during processing. The upper portion 206 is configured to interface with the annular flexible membrane 209. A plurality of recesses 601 are formed between the upper portion 206 and the lower portion 207.

Figure 6:
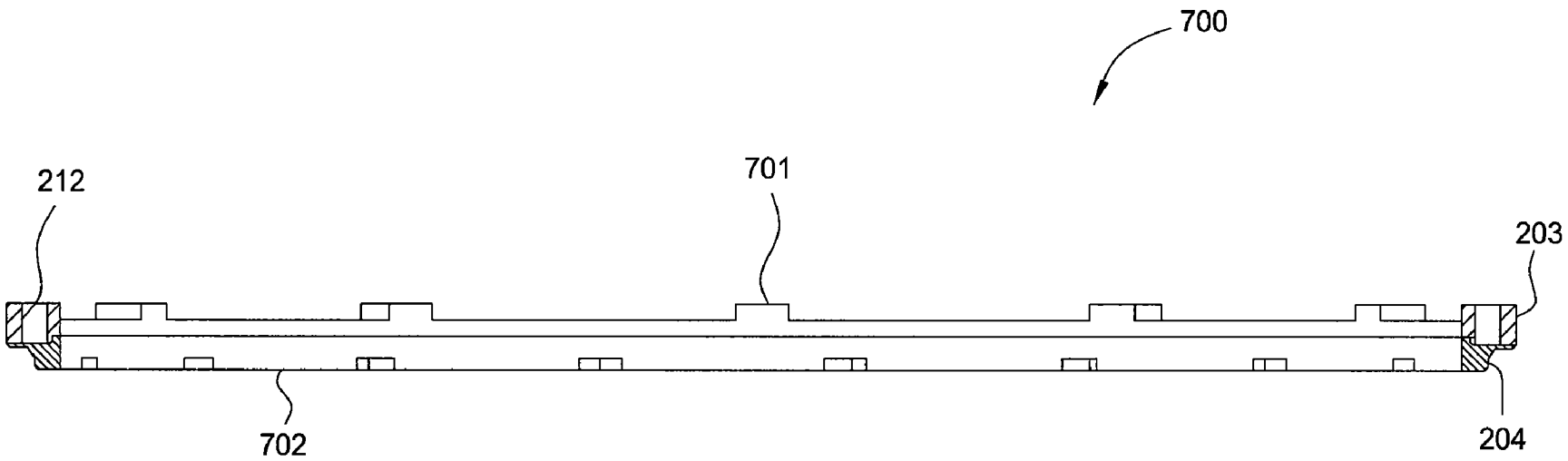
FIG. 6 schematically shows a carrier ring in accordance with one embodiment of the present invention.

According to one embodiment, as seen in FIG. 6, the carrier ring 700 comprises a lower portion 204, configured to contact the polishing surface 804. The lower portion 204 is coupled to an upper portion 203, and the upper portion 203 can be further coupled to the carrier head 110 in accordance to one embodiment. Partially raised surfaces 701 on an upper portion 203 of the carrier ring 700 provide a coupling area for the flexures 300A or carrier head 110. Slurry escape recesses 202 are formed between the carrier ring 700 and the carrier head 110 between the neighboring raised surfaces 701.

The flexures 300A are coupled within the recesses 601 of the upper portion 206 of the retaining ring 600, and within the slurry escape recesses 202 between the carrier head 110 to the upper portion 203 of the carrier ring 700. The flexures 300A may be coupled to the carrier ring 700 and retaining ring 600 through conventional fasteners (not shown), such as bolts or screw, or any other fastening means. In one embodiment the retaining ring 600 has holes 211 where the flexures 300A may be coupled. The carrier ring 700 may have holes 212 configured to connect with the flexures 300A.

The raised surfaces 701 of the carrier ring 700 provide a spacing from the surrounding top surfaces so that the flexure 300A may bend properly, providing an even force at the coupling of the retaining ring 600. The carrier ring 700 can be used to reference the position of the retaining ring 600 relative to the polishing surface based on wear of the retaining ring 600 and carrier ring 700 surfaces. The carrier ring 700 also adds structural support to the whole carrier head 110.

In one embodiment, the carrier ring 700 and retaining ring 600 have lower surfaces adapted to contact a polishing surface so that the lower surfaces may lie in a same plane as a lower surface of the substrate 109. This allows the retaining ring 600 to retain the substrate 109 by contacting an outer edge of the substrate 109 during processing. This further allows for referencing of the carrier head relative to a polishing surface 804 by contacting a lower surface of the carrier ring 700 to the polishing surface 804.

These slurry escape recesses 202 and upper retaining ring recesses 601 allow for processing fluid to circulate out of the processing area 205, shown in FIG. 3.

Figure 7A:
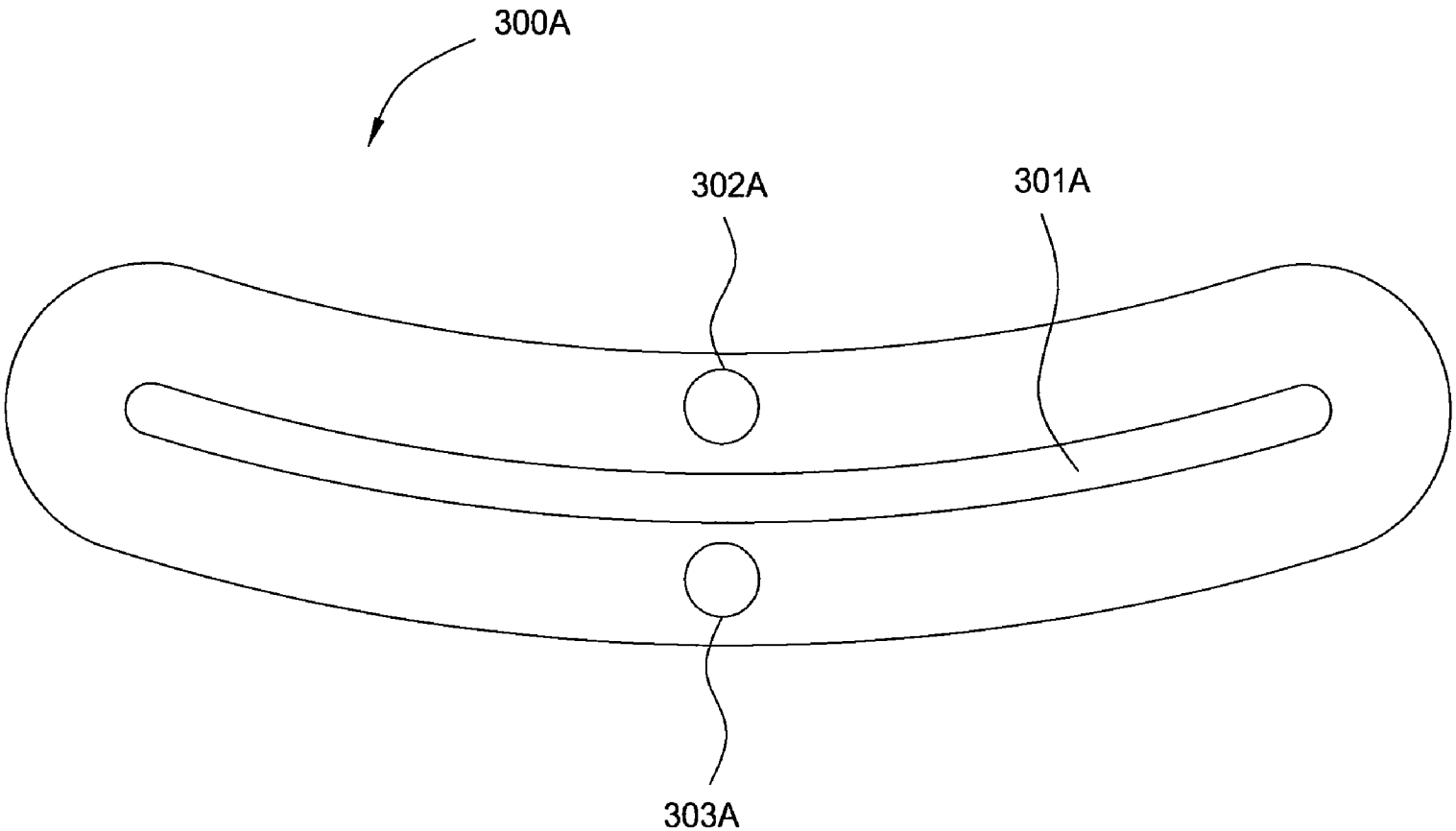
FIG. 7A schematically illustrates a flexure in accordance with one embodiment of the present invention.
Figure 7B:
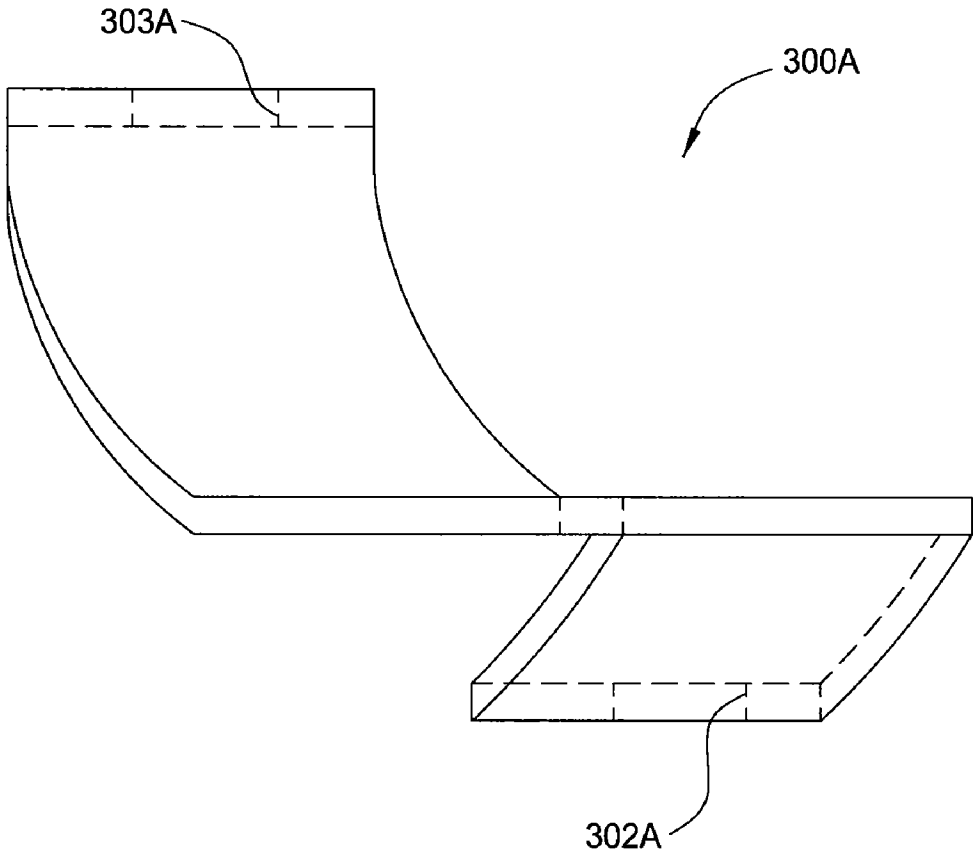
FIG. 7B is a schematically side view of the flexure of FIG. 7A in a flexed position.
Figure 7C:
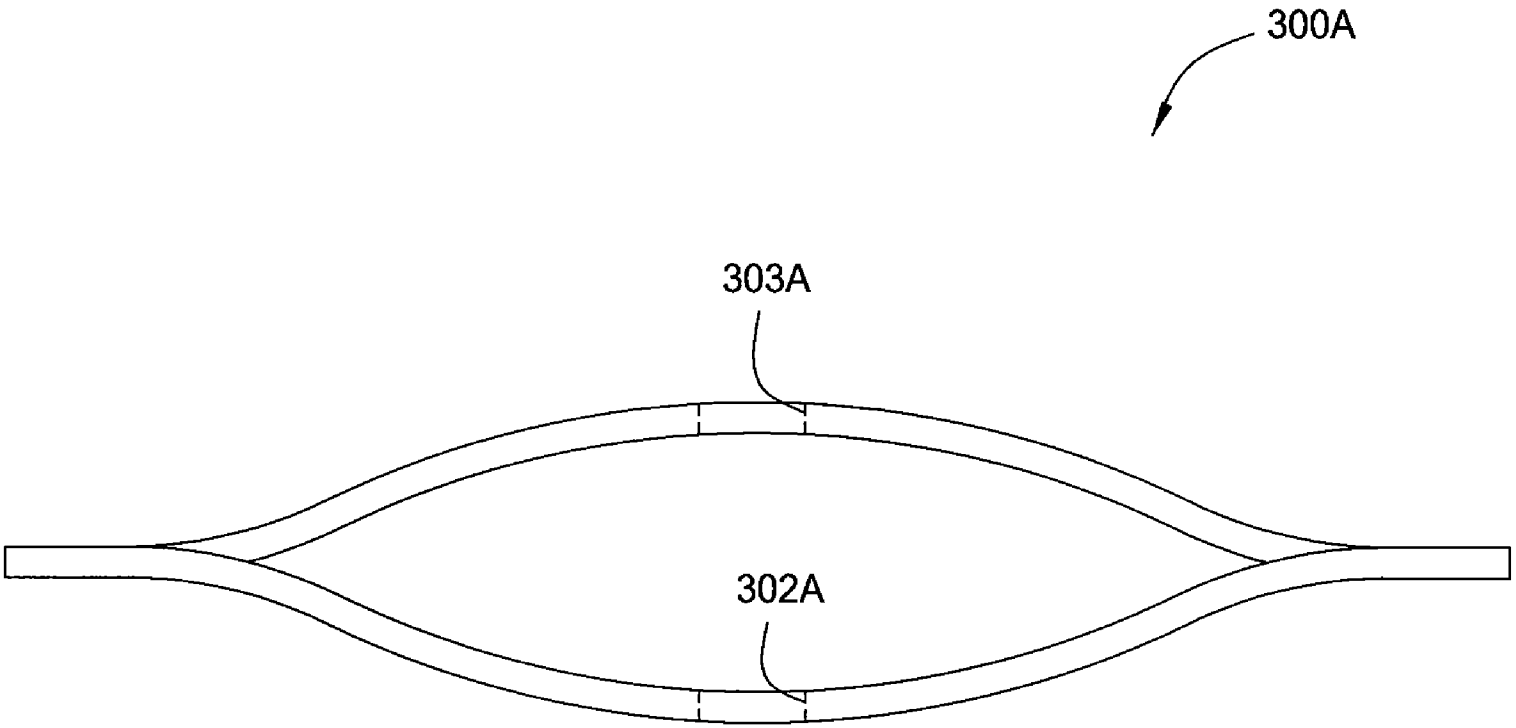
FIG. 7C is a schematically further side view of the flexure of FIG. 7A in a flexed position.

FIG. 7A is a schematic top view of the flexure 300A in accordance with one embodiment. FIGS. 7B and 7C illustrate schematic side views of the flexure 300A.

The flexure 300A is a plate with a slot 301A running down its length. In one embodiment, the plate may have an elliptical shape. On either side near a center of the plate, there are coupling holes 302A, 303A which allow the flexure 300A to be coupled to the carrier ring 700 and retaining ring 600. As shown in FIG. 3, the couple holes 302A and 303A are aligned with holes 211 of the carrier ring 700 and the holes 212 of the retaining ring 600 respectively. The flexure 300A is fastened to both the retaining ring 600 and carrier ring 700 and provides lateral forces to the retaining ring 600 from the carrier ring 700 to keep the retaining ring 600 in a position to polish the substrate.

In one embodiment, the flexure 300A is made of a suitable material, such as a stainless steel, so that the flexure 300A may withstand the harsh liquid environment of the polishing process area. The flexure 300A may also be constructed of other materials, including, but not limited to, plastics, polymers, composites, and other metals, including, but not limited to, tungsten, aluminum, copper, and nickel, or combinations thereof.

Figure 8:
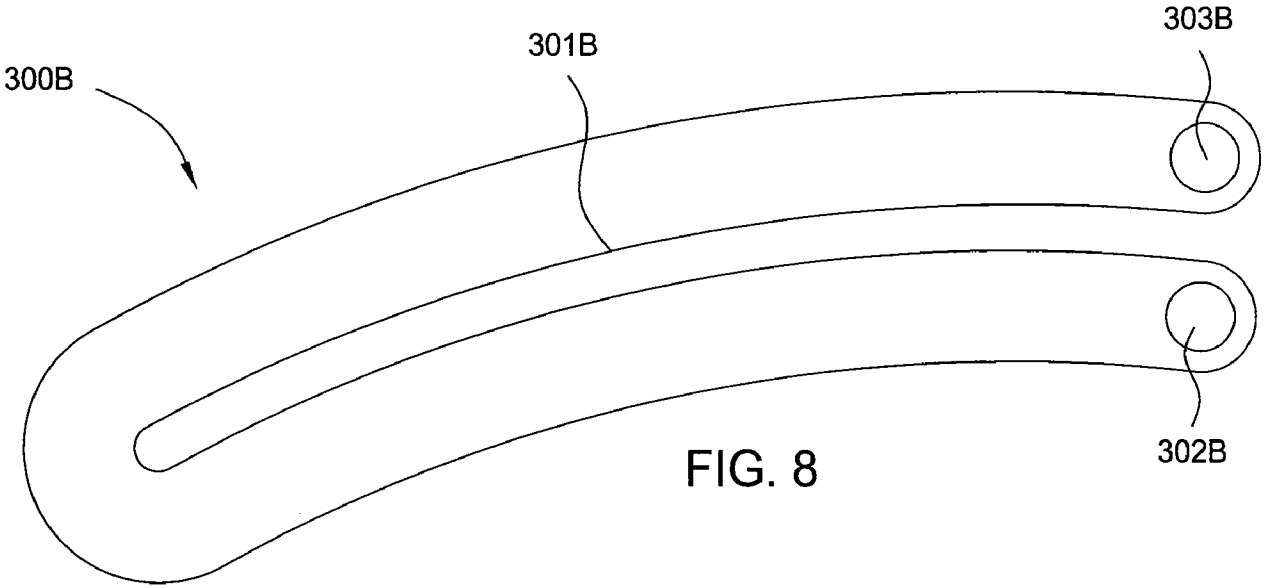
FIG. 8 schematically illustrates a flexure in accordance with one embodiment of the present invention.

In another embodiment, a flexure 300B may be an elliptical plate with a slot 301B terminating at one end of the plate, as shown in FIG. 8. At the end where the slot 301B terminates, holes 302B, 303B are formed for coupling to the carrier ring 700 and retaining ring 600.

Figure 9:
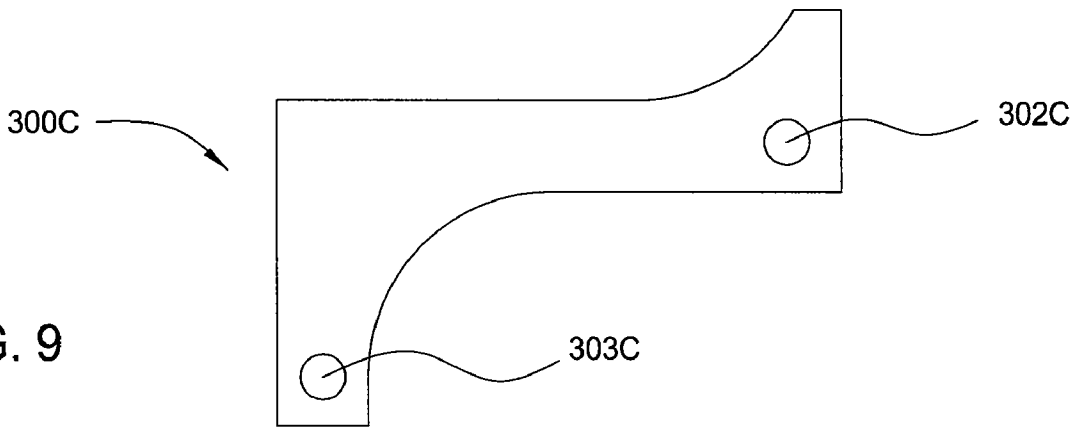
FIG. 9 schematically illustrates a flexure in accordance with one embodiment of the present invention.

In another embodiment, a flexure 300C may be a rectangular plate with a removed corner and an added protrusion in another corner, as shown in FIG. 9. The flexure 300A may also contain holes 302C, 303C for coupling to the retaining ring 600 and carrier ring 700.

While the foregoing is directed to embodiments, other and further embodiments may be devised without departing from the basic scope thereof, and the scope thereof is determined by the claims that follow.

What is claimed is:

1. A retaining ring assembly, comprising:

a retaining ring configured to circumferentially surround and retain the substrate within an inner surface of the retaining ring; and a flexure coupled to the retaining ring, wherein the flexure is configured to maintain a gap between an inner surface of a carrier ring and an outer surface of the retaining ring, and the carrier ring is circumferentially surrounding the retaining ring, and the flexure comprises a plate having a slot that extends substantially down a length of the plate.

2. The retaining ring assembly of claim 1, wherein the plate comprises a first and second portion, the slot is positioned between the first and second portion of the plate, and the first portion of the plate is coupled to the retaining ring and the second portion of the plate is coupled to the carrier ring.

3. The retaining ring assembly of claim 1, wherein a lower surface of the retaining ring and a lower surface of the carrier ring are maintained in a same plane during processing of the substrate.

4. The retaining ring assembly of claim 3, further comprising an annular flexible membrane coupled to the retaining ring, wherein the annular flexible membrane is configured to move the retaining ring parallel to the inner surface of the carrier ring by inflating and deflating.

5. The retaining ring assembly of claim 3, wherein the retaining ring is moveable parallel to the inner surface of the carrier ring, and the flexure deforms when the retaining ring is moved parallel to the inner surface of the carrier ring.

6. A carrier head for retaining a substrate during processing, comprising:

a retaining ring configured to circumferentially surround and retain the substrate within an inner surface of the retaining ring;

a carrier ring circumferentially surrounding the retaining ring; and a flexure coupled between the carrier ring and retaining ring, wherein the flexure is substantially resistive to movement of the retaining ring in a direction perpendicular to an inner surface of the carrier ring and substantially non resistive to movement of the retaining ring in a direction parallel to the inner surface of the carrier ring, and the flexure comprises a plate having a slot that extends substantially down a length of the plate.

7. The carrier head of claim 6, wherein the flexure is configured to maintain a gap between the inner surface of the carrier ring and an outer surface of the retaining ring.

8. The carrier head of claim 6, wherein a lower surface of the retaining ring and a lower surface of the carrier ring are maintained in a same plane during processing of the substrate.

9. The carrier head of claim 8, further comprising an annular flexible membrane configured to move the retaining ring along the direction parallel to the inner surface of the carrier ring.

10. The carrier head of claim 8, wherein the retaining ring is moveable parallel to the inner surface of the carrier ring, and wherein the flexure deforms when the retaining ring is moved parallel to the inner surface of the carrier ring.

11. A polishing head assembly for retaining a substrate during polishing, comprising:

a carrier head;

an annular flexible membrane coupled to the carrier head;

a retaining ring, configured to circumferentially surround and retain the substrate within an inner surface of the retaining ring, coupled to the annular flexible membrane;

a carrier ring circumferentially surrounding the retaining ring and coupled to the carrier head; and a flexure coupled between the carrier ring and retaining ring, wherein the flexure comprises a plurality of plates evenly distributed along the retaining ring and the carrier ring.

12. The polishing head assembly of claim 11, wherein the flexure is configured to maintain a gap between an inner surface of the carrier ring and an outer surface of the retaining ring.

13. The polishing head assembly of claim 12, wherein the flexible membrane is inflated or deflated, thereby moving the retaining ring parallel to the inner surface of the carrier ring.

14. The polishing head assembly of claim 13, wherein a lower surface of the retaining ring and a lower surface of the carrier ring are maintained in a same plane during processing of the substrate.

15. The polishing head assembly of claim 14, wherein the lower surface of the retaining ring and the lower surface of the carrier ring are configured for contacting a polishing surface.

16. The polishing head assembly of claim 13, wherein the flexure deforms when the retaining ring is moved parallel to the inner surface of the carrier ring.

17. The polishing head assembly of claim 11, wherein each of the plurality of plates comprises:

a first portion configured to couple with the retaining ring; and a second portion configured to couple with the carrier ring, wherein a slot is formed between the first portion and the second portion.

18. The polishing head assembly of claim 11, further comprising:

a circular flexible membrane coupled to the carrier head, wherein the circular flexible membrane is configured to contact a surface of the substrate and to secure the substrate thereon.

19. The retaining ring assembly of claim 1, further comprising one or more additional flexures stacked on the flexure.

20. The carrier head of claim 6, further comprising one or more additional flexures stacked on the flexure.

* * * * *

UNITED STATES PATENT AND TRADEMARK OFFICE

CERTIFICATE OF CORRECTION

PATENT NO. : 7,749,052 B2
APPLICATION NO. : 12/206338
DATED : July 6, 2010
INVENTOR(S) : Yi et al.

It is certified that error appears in the above-identified patent and that said Letters Patent is hereby corrected as shown below:

In the Inventors (75):

Please insert --Hsu-- after Chu-Chiang.

Signed and Sealed this

Sixteenth Day of November, 2010

David J. Kappos

David J. Kappos
*Director of the United States Patent and Trademark Office*